US009018857B2

(12) United States Patent
Chen

(10) Patent No.: US 9,018,857 B2
(45) Date of Patent: Apr. 28, 2015

(54) LED BACKLIGHT DRIVING CIRCUIT, LCD DEVICE, AND METHOD FOR DRIVING THE LED BACKLIGHT DRIVING CIRCUIT

(71) Applicant: Shenzhen China Star Optoelectronics Technology Co., Ltd, Shenzhen (CN)

(72) Inventor: Xinhong Chen, Shenzhen (CN)

( * ) Notice: Subject to any disclaimer, the term of this patent is extended or adjusted under 35 U.S.C. 154(b) by 0 days.

(21) Appl. No.: 14/004,418

(22) PCT Filed: Jun. 28, 2013

(86) PCT No.: PCT/CN2013/078243

§ 371 (c)(1),
(2) Date: Sep. 11, 2013

(87) PCT Pub. No.: WO2014/190579

PCT Pub. Date: Dec. 4, 2014

(65) Prior Publication Data

US 2014/0354176 A1 Dec. 4, 2014

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 37/00*** | (2006.01) |
| ***H05B 39/00*** | (2006.01) |
| ***H05B 41/00*** | (2006.01) |
| ***G09G 3/34*** | (2006.01) |
| ***H05B 33/08*** | (2006.01) |

(52) U.S. Cl.

CPC ..... *G09G 3/3406* (2013.01); *H05B 33/0845* (2013.01)

(58) Field of Classification Search

None

See application file for complete search history.

(56) References Cited

U.S. PATENT DOCUMENTS 8,564,507 B2 * 10/2013 Jang et al. ..... 345/76
2011/0133659 A1 6/2011 Li et al.

FOREIGN PATENT DOCUMENTS

| | | | |
|---|---|---|---|
| CN | 101586751 | A | 11/2009 |
| CN | 102065596 | A | 5/2011 |
| CN | 102243388 | A | 11/2011 |
| CN | JP4845395 | B2 | 12/2011 |
| CN | 102610199 | A | 7/2012 |
| CN | 102610207 | A | 7/2012 |
| CN | 102629451 | A | 8/2012 |
| CN | 103037589 | A | 4/2013 |

OTHER PUBLICATIONS

Yang Xue, the International Searching Authority written comments, Mar. 2014, CN.

* cited by examiner

*Primary Examiner* — Douglas W Owens
*Assistant Examiner* — Dedei K Hammond

(57) ABSTRACT

A light emitting diode (LED) backlight driving circuit includes a power supply, a constant current driving unit that drives LED light bars, a switching unit coupled to the power supply, and M light units that are connected with each other in parallel. Each of the light units comprises at least two LED light bars that are connected with each other in parallel, and an input end of each of the LED light bars is coupled to the switching unit. The constant current driving unit includes a plurality of dimming channels coupled to an output end of the LED light bars, and each of the dimming channels is connected with M LED light bars. The M LED light bars connected with a same dimming channel are arranged in different light units, one LED light bar is coupled to one dimming channel. The power supply is only coupled to one light unit through the switching unit when the LED backlight driving circuit is in operation, and M is a positive integer.

17 Claims, 3 Drawing Sheets

LED BACKLIGHT DRIVING CIRCUIT, LCD DEVICE, AND METHOD FOR DRIVING THE LED BACKLIGHT DRIVING CIRCUIT

TECHNICAL FIELD

The present disclosure relates to the field of liquid crystal displays (LCDs), and more particularly to a light emitting diode (LED) backlight driving circuit, an LCD device, and a method for driving the LED backlight driving circuit.

BACKGROUND

Many electrical products have a display device, and many different parameters are used to determine quality of the display devices, where contrast ratio (CR) is one important parameter. As the CR increases, an image of the display device becomes more vivid and more colorful. A common display device divides grey scales into 255 grades, where the CR is equal to a specific value between surface luminance of 255th grey scale L255 and surface luminance of original grey scale L0. An equation of the Cr is: CR=surface luminance of L255/surface luminance of L0.

A surface luminance of the 255th grey scale L255 of a thin film transistor liquid crystal display (TFT-LCD) device is not prone to increase because of limiting factors, such as a maximum backlight brightness and penetration rate of glass. A surface luminance of original grey scale L0 of the TFT-LCD device obtains through a local dimming method.

Currently, two main backlight local dimming methods are as follow:

A: a first backlight local dimming method is a side-light backlight local dimming method. An advantage of the first backlight local dimming method is acceptable cost, and a disadvantage of the first backlight local dimming method is few backlight blocks of the light units, a number of the backlight blocks of the light units is generally 2*6 or 2*8.

B: a second backlight local dimming method is direct-light backlight local dimming method. An advantage of the second backlight local dimming method is a plurality of the backlight blocks of the light units and good dimming effect, and a disadvantage of the second backlight local dimming method is that cost and the number of the backlight blocks of the light units are directly proportional.

The number of the backlight blocks of the light units is generally determined by a number of dimming channels of a backlight driving unit, where the backlight driving unit drives a light emitting diode (LED) light bar to light. Taking a backlight having 16 backlight blocks of the light units for example, a backlight driving unit having 16 dimming channels is needed to drive the LED light bar of each of the 16 backlight blocks of the light units to light, or the LED light bar of each of the 16 backlight blocks of the light units is driven to light by a plurality of backlight driving units. For a large size LCD panel, the direct backlight has a plurality of the backlight blocks of light units, and the dimming channel of the backlight driving unit correspondingly increases, thereby increasing costs.

SUMMARY

In view of the above-described problems, the aim of the present disclosure is to provide a light emitting diode (LED) backlight driving circuit, a liquid crystal display (LCD) device, and a method for driving the LED backlight driving circuit capable of improving contrast ratio (CR) and reducing costs.

The purpose of the invention is achieved by the following technical schemes:

A light emitting diode (LED) backlight driving circuit comprises a power supply, a constant current driving unit that drives LED light bars, a switching unit coupled to the power supply, and M light units that are connected with each other in parallel. Each of the light units comprises at least two LED light bars that are connected with each other in parallel, and an input end of each of the LED light bars is coupled to the switching unit. The constant current driving unit comprises a plurality of dimming channels coupled to an output end of the LED light bars, each of the dimming channels is connected with M LED light bars, the M LED light bars connected with a same dimming channel are arranged in different light units, one LED light bar is coupled to one dimming channel. The power supply is only coupled to one light unit through the switching unit when the LED backlight driving circuit is in operation, where M is a positive integer.

When a number of the LED light bars of each of the light units is same, a number of the LED light bars connected with each of the dimming channels is same, thus all light units may be driven by a same driving method, design of the LED backlight driving circuit is simple and convenient. It should be considered that the number of the LED light bars of each of the light units may be different, and the method for driving the light unit needs to be designed according to different light units.

Furthermore, the switching unit comprises M change-over controllable switches that are connected with each other in parallel, an input end of each of the change-over controllable switches is coupled to the power supply, an output end of each of the change-over controllable switches is correspondingly connected with one light unit, only one change-over controllable switch turns on when the LED backlight driving circuit is in operation. This is a specific circuit of the switching unit, and the change-over controllable switch controls the light unit to be connected with the power, which simplifies design and reduces cost.

Furthermore, the dimming channel comprises a dimming controllable switch connected in series between an output end of the light unit and a ground terminal of the LED backlight driving circuit, the constant current driving unit comprises a control unit coupled to the dimming controllable switch. This is a specific circuit of the dimming channel.

Furthermore, the constant current driving unit further comprises a switching channel that controls the change-over controllable switch to turn on/off. A typical constant current driving chip having N channels only drives N LED light bars, however, the constant current driving chip having N channels of the present disclosure drives M*(N−M) LED light bars. Taking a constant current driving chip having 18 channels for example, the typical constant current driving chip only drives 18 LED light bars by a typical method. In the present disclosure, if the LED light bars are divided into two groups, the constant current driving chip drives 32 (namely 2*(18−2)=32) LED light bars, and a number of the LED light bars driven using the method of the present disclosure is 1.78 times a number of the LED light bars driven using the typical method. Thus, the present disclosure increases the number of the LED light bar driven by single constant current driving chip without increasing other monitor circuits, which reduces hardware costs.

Furthermore, the light unit comprises a first light unit and a second light unit, the change-over controllable switch comprises a first change-over controllable switch coupled to the first light unit, and a second change-over controllable switch coupled to the second light unit. The switching channel comprises a first control switch and a second control switch. The LED backlight driving circuit further comprises a first resistor, a second resistor, a third resistor, and a fourth resistor. The first resistor is connected in series between a control end of the first change-over controllable switch and an output end of the power supply. A first end of the second resistor is coupled to the control end of the first change-over controllable switch, and a second end of the second resistor is connected with a ground terminal through the first control switch. The third resistor is connected in series between a control end of the second change-over controllable switch and the output end of the power supply. A first end of the fourth resistor is coupled to the control end of the second change-over controllable switch, and a second end of the fourth resistor is connected with the ground terminal through the second control switch. This is a method of two connected-in-parallel light units, the two light units correspond to two change-over controllable switches, each of the change-over controllable switches has one switching channel, which does not affect each other, thereby having high reliability.

Furthermore, the light unit comprises a first light unit and a second light unit, the change-over controllable switch comprises a first change-over controllable switch coupled to the first light unit, and a second change-over controllable switch coupled to the second light unit. The first change-over controllable switch and the second change-over controllable switch are coupled to a same switching channel. The first change-over controllable switch turns on at a high level, the second change-over controllable switch turns on at a low level. The switching channel comprises a control switch. The LED backlight driving circuit further comprises a first resistor, a second resistor, a third resistor, and a fourth resistor. The first resistor is connected in series between a control end of the first change-over controllable switch and an output end of the power supply. A first end of the second resistor is coupled to the control end of the first change-over controllable switch, and a second end of the second resistor is connected with a ground terminal through the control switch. The third resistor is connected in series between a control end of the second change-over controllable switch and the output end of the power supply. A first end of the fourth resistor is coupled to the control end of the second change-over controllable switch, and a second end of the fourth resistor is connected with the ground terminal through the control switch. This is a method of two connected-in-parallel light units, two light units correspond to two change-over controllable switches and action logical operation of the two change-over controllable switches are opposite. The two change-over controllable switches uses together one switching channel, which reduces the number of the switching channel and hardware costs.

Furthermore, the switching unit comprises a delay switching unit coupled to the change-over controllable switch, the delay switching unit outputs a signal to turn off all change-over controllable switches in a preset delay time after a current light unit turns off, and the change-over controllable switch corresponding to next light unit is driven to turn on. A dead-time is added into a time of switching between two adjacent light units through the delay switching unit, and all light units turns off in the dead-time. The next light unit is driven to light after the dead-time, thus the next light unit is driven to light after the current light unit is completely off, which avoids two light units from simultaneously lighting, thereby improving reliability of the switching.

Furthermore, the constant current driving unit further comprises a current compensator unit coupled to the control unit, and the current compensator unit increases a current flowing through the LED light bar. The dimming channel of the constant current driving unit is connected with N LED light bars, when a total time of turning on each of the dimming channels is constant, specific value of a time of turning on each of the LED light bars of the present disclosure and a time of turning on a typical LED light bar is 1/N, namely brightness of the LED light bar reduces. The current compensation unit may increase the current flowing through the LED light bars by increasing an output voltage of the power supply or increasing a duty cycle of current flowing through the LED light bars, which compensates brightness loss of the LED light bars.

A liquid crystal display (LCD) device comprises the LED backlight driving circuit of the present disclosure.

A method for driving a light emitting diode (LED) backlight driving circuit, the LED backlight driving circuit comprising a power supply, an LED light bar, and a constant current driving unit that drives the LED light bar to light, the method comprises:

A: connecting M light units with each other in parallel, wherein N light bars are one light units, and the N LED light bars are connected with each other in parallel.

B: connecting M LED light bars with a same dimming channel of the constant current driving unit, wherein the M LED light bars are arranged in different light units.

C: controlling one light unit to couple to the power supply for a time.

D: controlling the dimming channel of the constant current driving unit to turn on when one light unit is on.

M and N are positive integers.

The LED light bars are divided into M light units in the present disclosure, each of the light units has a plurality of LED light bars (such as N LED light bars), and the light units are coupled to the power supply through the switching unit. The switching unit controls only one light unit to be connected with the power supply in the same the time, and the constant current driving unit only drives N LED light bars within the time. When next light unit is connected with the power supply through the switching unit, the constant current driving unit also only drives N LED light bars. Thus, the LED light bars of different light units may use the same dimming channel of the constant current driving unit, and the M*N LED light bars are driven by the constant current driving unit only having N dimming channels. The backlight blocks of the light units of the present disclosure has no change, but the dimming channel is reduced, which improves contrast ratio (CR) and reduces hardware cost.

DETAILED DESCRIPTION

Figure 1:
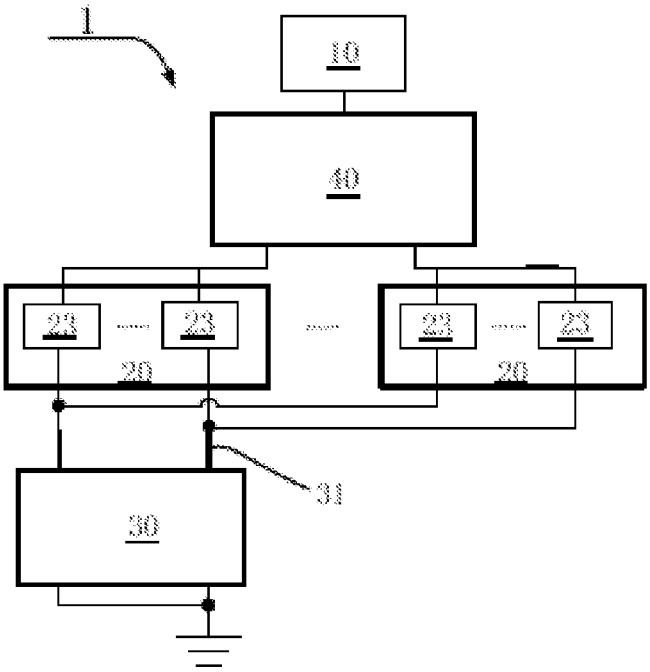
FIG. 1 is a schematic diagram of a light emitting diode (LED) backlight driving circuit of the present disclosure.

The present disclosure provides a liquid crystal display (LCD) device, and the LCD device comprises a light emitting diode (LED) backlight driving circuit 1. As shown in FIG. 1, the LED backlight driving circuit 1 comprises a power supply 10, a constant current driving unit 30 that drives LED light bars 23, a switching unit 40 coupled to the power supply 10, and M light units 20 that are connected with each other in parallel. Each of the M light units 20 comprises at least two LED light bars 23 that are connected with each other in parallel, and an input end of each of the LED light bars 23 is coupled to the switching unit 40.

The constant current driving unit 30 comprises a plurality of dimming channels 31 coupled to an output end of the LED light bars 23, each of the dimming channels 31 is connected with M LED light bars 23, and the LED light bars 23 connected with a same dimming channel 31 are arranged in different light units 20. One LED light bar 23 is only coupled to one dimming channel 31. Only one light unit 20 is coupled to the power supply 10 through the switching unit 40 when the LED backlight driving circuit is in operation. The M is a positive integer.

When a number of the LED light bars of each of the light units is same, a number of the LED light bars connected with each of the dimming channels is same, thus all light units 20 may be driven by a same driving method, design of the LED backlight driving circuit is simple and convenient. It should be considered that a number of the LED light bars of each of the light units may be different, and the method for driving the light unit needs to be designed according to different light units.

The LED light bars are divided into M light units in the present disclosure, each of the light units has a plurality of LED light bars (such as N LED light bars), and the light units are coupled to the power supply through the switching unit. The switching unit controls only one light unit to be connected with the power supply when the LED backlight driving circuit is in operation, and the constant current driving unit only drives N LED light bars. When next light unit is connected with the power supply through the switching unit, the constant current driving unit also only drives N LED light bars. Thus, the LED light bars of different light units may use the same dimming channel of the constant current driving unit, and the M*N LED light bars are driven by the constant current driving unit only having N dimming channels. The backlight blocks of the light units of the present disclosure has no change, but the dimming channel is reduced, which improves contrast ratio (CR) and reduces hardware cost.

The invention will further be described in detail in accordance with the figure and the exemplary examples.

Example 1

Figure 2:
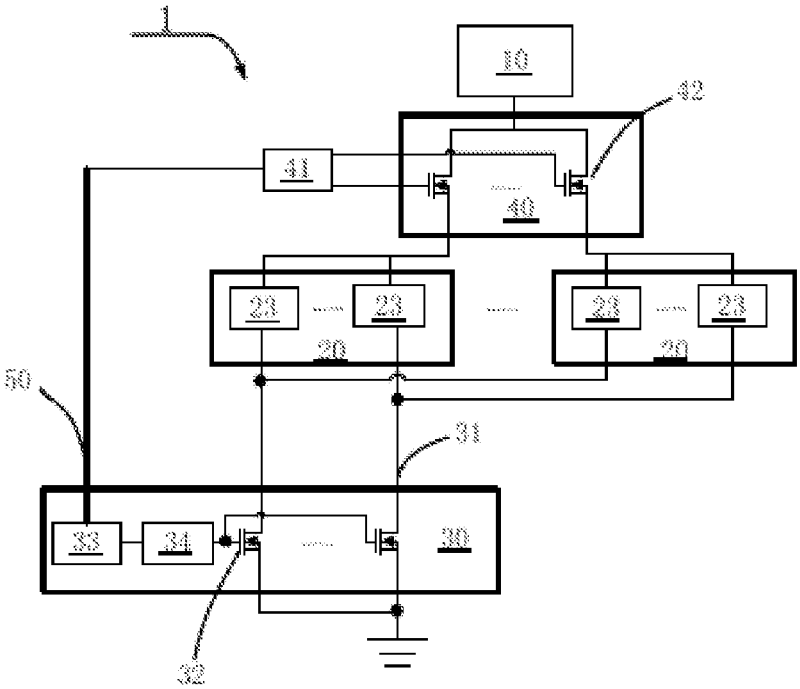
FIG. 2 is a schematic diagram of a light emitting diode (LED) backlight driving circuit of a first example of the present disclosure.

As shown in FIG. 2, the switching unit 40 comprises M change-over controllable switches 42 that are connected with each other in parallel. An input end of each of the change-over controllable switches 42 is coupled to the power supply 10, an output end of each of the change-over controllable switches 42 is connected with one light unit 20, and only one change-over controllable switch 42 is when the LED backlight driving circuit is in operation. The switching unit 40 further comprises a delay switching unit 41 coupled to the change-over controllable switch 42, when current light unit is off, the delay switching unit 41 sends a signal to turn off all controllable switches 42 in a present time, and then the change-over controllable switch 42 corresponding to next light unit 20 is driven to turn on.

The switching unit 40 uses the change-over controllable switch 42 to connect the light unit 20 with the power, which simplifies design and reduces costs. A dead-time is added into a time of switching between two adjacent light units 20 through the delay switching unit 41, and all light units 20 turns off in the dead-time. The next light unit 20 is driven after the dead-time, thus the next light unit 20 is driven after the current light unit turns completely off, which avoids two light units 20 from simultaneously lighting, thereby improving reliability of the switching.

The dimming channel 31 comprises a dimming controllable switch 32 connected in series between an output end of the light unit 20 and a ground terminal of the LED backlight driving circuit 1. The constant current driving unit 30 comprises a control unit 33 coupled to the dimming controllable switch 32, and a current compensation unit 34, where the current compensation unit 34 is coupled to the control unit 33 and is used to increase current flowing through the LED light bar 23. The dimming channel 31 of the constant current driving unit 30 is connected with N LED light bars 23, when a total time of turning on each of the dimming channels is constant, a specific value of a time of turning on each of the LED light bars of the present disclosure and a time of turning on a typical LED light bar is 1/N, namely brightness of the LED light bar 23 reduces. Thus, the current compensation unit 34 increases the current flowing through the LED light bars 23 by increasing an output voltage of the power supply 10 or increasing a duty cycle of current flowing through the LED light bars 23, which compensates brightness loss of the LED light bars 23.

The constant current driving unit 30 further comprises a switching channel 50 that controls the change-over controllable switch 42 to turn on/off. Function of the switching channel 50 and function of a dimming controllable switch 32 of a typical constant current driving chip are same, namely M dimming channels 31 of the constant current driving chip are regarded as the switching channels 50, the dimming controllable switch 32 is regarded as the change-over controllable switch 42 of the switching unit 40, and the control unit 33 of the constant current driving unit 30 is used to drives the change-over controllable switch 42 to turn on/off. A typical constant current driving chip having N channels only drives N LED light bars, however, the constant current driving chip having N channels of the present disclosure drives M*(N−M) LED light bars. Taking a constant current driving chip having 18 channels for example, the typical constant current driving chip only drives 18 LED light bars by a typical method. In the present disclosure, if the LED light bars are divided into groups (namely M=2), the constant current driving chip drives 32 (namely 2*(18−2)=32) LED light bars, and a number of the LED light bars driven using the method of the present disclosure is 1.78 times a number of the LED light bars driven using the typical method. Thus, the present disclosure increases the number of the LED light bar driven by single constant current driving chip without increasing other monitor circuits, which reduces hardware costs.

The present disclosure uses the constant current driving chip to control the change-over controllable switch 42 without other monitor circuits, which simplifies design and reduces hardware costs.

The first example is also used for a global dimming by controlling a duty cycle of the change-over controllable switch.

Example 2

Figure 3:
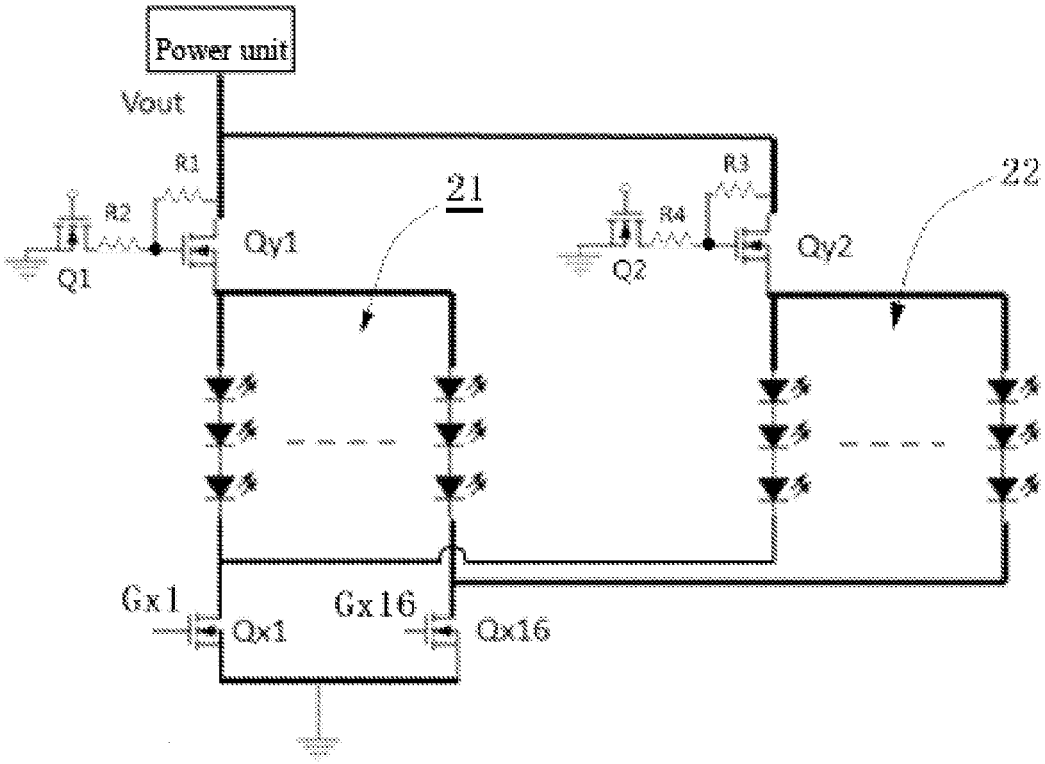
FIG. 3 is a schematic diagram of a light emitting diode (LED) backlight driving circuit of a second example of the present disclosure.

As shown in FIG. 3, a second example takes two light units for example, the light units comprises a first light unit 21 and a second light unit 22, the change-over controllable switch comprises a first change-over controllable switch Qy1 coupled to the first light unit 21, and a second change-over controllable switch Qy2 coupled to the first light unit 22. The switching channel comprises a first control switch Q1 and a second control switch Q2. The LED backlight driving circuit further comprises a first resistor R1, a second resistor R2, a third resistor R3, and a fourth resistor R4. The first resistor R1 is connected in series between a control end of the first change-over controllable switch Qy1 and an output end of the power supply. A first end of the second resistor R2 is coupled to the control end of the first change-over controllable switch Qy1, a second end of the second resistor R2 is connected with the ground terminal through the first control switch Q1. The third resistor R3 is connected in series between a control end of the second change-over controllable switch Qy2 and the output end of the power supply. A first end of the fourth resistor R4 is coupled to the control end of the second change-over controllable switch Qy2, a second end of the second resistor R2 is connected with the ground terminal through the second control switch Q2. The control unit is coupled to control ends of the first control switch Q1 and the second control switch Q2 through the delay switching unit.

It should be considered that the control unit (the control unit is shown in FIG. 2 and now shown in FIG. 3) directly controls the first change-over controllable switch Qy1 and the second change-over controllable switch Qy2 to turn on/off without the delay switching unit in the present disclosure.

If the constant current driving chip has 18 channels, the 18 channels are divided into two groups, a first group is regarded as the switching channels Gy1 and Gy2, and a second group is regarded as the dimming channels Gx1-Gx16. The switching channels Gy1 and Gy2 are used to drive metal-oxide-semiconductor field-effect transistors (MOSFET) Qy1, Qy2 (Qy1 and Qy2 are shown in FIG. 3), and the dimming channels Gx1-Gx16 are used to drive MOSFET Qx1-Qx16. A block controlled by the Qy1 and Qx1 is named Y1X1, a block controlled by the Qy2 and Qx16 is named Y2X16, and the like. The backlight is divided into 32 blocks as shown in the following table:

| | | | |
|---|---|---|---|
| Y1X1 | Y1X2 | Y1X3 | Y1X4 |
| Y1X5 | Y1X6 | Y1X7 | Y1X8 |
| Y1X9 | Y1X10 | Y1X11 | Y1X12 |
| Y1X13 | Y1X14 | Y1X15 | Y1X16 |
| Y2X1 | Y2X2 | Y2X3 | Y2X4 |
| Y2X5 | Y2X6 | Y2X7 | Y2X8 |
| Y2X9 | Y2X10 | Y2X11 | Y2X12 |
| Y2X13 | Y2X14 | Y2X15 | Y2X16 |

Figure 4:
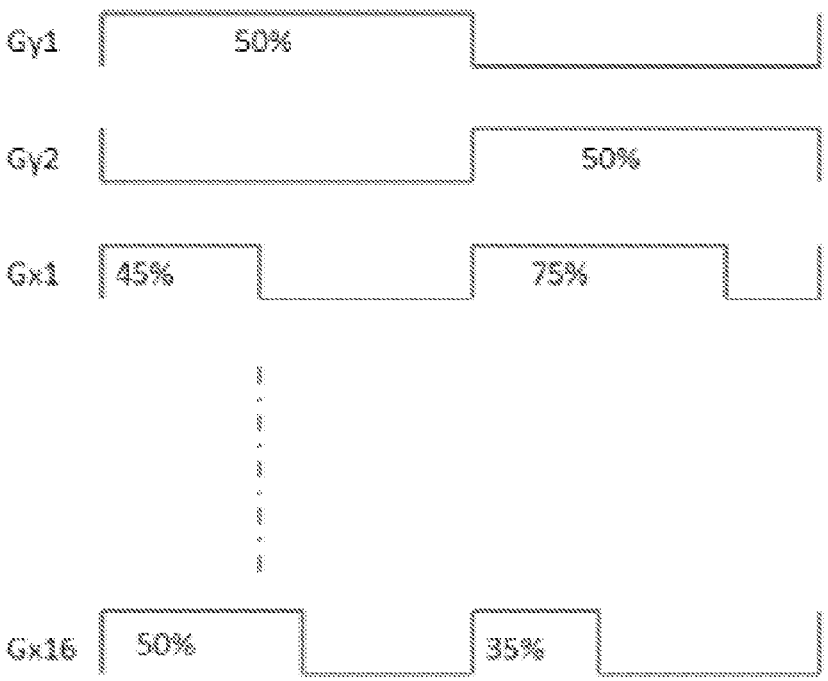
FIG. 4 is a waveform diagram of driving a light emitting diode (LED) backlight driving circuit of a second example of the present disclosure.

According to principle of the time-division multiplexing, output frequencies of the Gy1 and Gy2 are Fy (120 Hz), and duty cycles of the Gy1 and Gy2 are Dy (50%). Output frequencies of the Gx1-Gx16 are Fx (240 Hz), and duty cycles of the Gx1-Gx16 are Dxn (Dxn depends on brightness requirement of the image, and algorithm of the Dxn depends on timing sequence of the backlight driving circuit). Waveforms of the Gy1, Gy2, and Gx1-Gx16 are shown in FIG. 4. Thus, a control mode of 32 blocks is formed on a basis of the constant current driving unit having 18 channels, the number of the blocks is 1.78 times the number of the channels (namely 32/18=1.78), which increases the number of the LED light bars driven by the singe constant current driving chip without other monitor circuits, and reduces hardware costs.

Lighting times of all blocks actually short, and duty cycle of the Y1X1 block is actually 22.5% (Dy1*Dx1=22.5%), which is a half of brightness requirement 45%. Thus the current compensator unit of the first example may be used to increases the current flowing through the LED light bars to compensate the brightness. A dead-time of 1% is added into a time of switching between the Gy1 and Gy2, which avoids two adjacent LED light bars from simultaneously lighting.

The second example may also be used for the global dimming by controlling the duty cycles Dy of the Gy1 and the Gy2.

In the second example, two light units correspond to two change-over controllable switches, and each of the change-over controllable switches has one switching channel, which does not affect each other, thereby improving reliability.

It should be understood that two change-over controllable switches can be controlled by one switching channel: the first change-over controllable switch Qy1 turns on by a high level signal (logic 1), and the second change-over controllable switch Qy2 turns on by a low level signal (logic 0), namely logical operation of the two change-over controllable switches are opposite. To be specific, the switching channel comprises the control switch. The LED backlight driving circuit further comprises the first resistor, the second resistor, the third resistor, and the fourth resistor. The first resistor is connected in series between the control end of the first change-over controllable switch and the output end of the power supply. The first end of the second resistor is coupled to the control end of the first change-over controllable switch, and the second end of the second resistor is connected with the ground terminal through the control switch. The third resistor is connected in series between the control end of the second change-over controllable switch and the output end of the power supply. The first end of the fourth resistor is coupled to the control end of the second change-over controllable switch, and the second end of the second resistor is connected with the ground terminal through the control switch. Two change-over controllable switches can be controlled by one switching channel, which reduces the switching channels (namely reduces the output pins of the constant current driving unit, thereby reducing hardware cost.

Example 3

Figure 5:
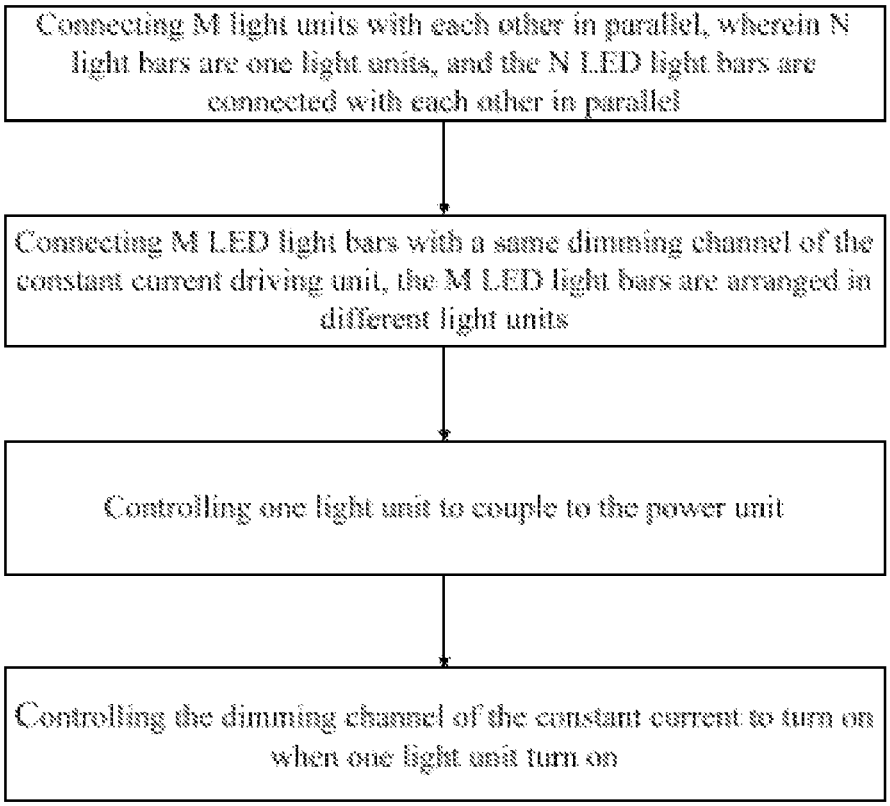
FIG. 5 is a flowchart of a method for driving a light emitting diode (LED) backlight driving circuit of a third example of the present disclosure.

As shown in FIG. 5, a third example provides a method for driving the LED backlight driving circuit, the LED backlight driving circuit comprises the power supply, the LED light bar, and the constant current driving unit which drives the LED light bar to light, the method comprises:

A: connecting M light units with each other in parallel, wherein N light bars are one light units, and the N LED light bars are connected with each other in parallel.

B: connecting M LED light bars with a same dimming channel of the constant current driving unit, where the M LED light bars are arranged in different light units.

C: controlling one light unit to couple to the power supply when the LED backlight driving circuit is in operation.

D: controlling the dimming channel of the constant current driving unit to turn on when one light unit turns on;

M and N are positive integers.

In the step C, the dead-time is added into the time of switching between two adjacent light units, and all light units turns off in the dead-time, next light unit is driven after the dead-time, which allows the next light unit to be driven after the current light unit turns completely off, thereby avoiding two light units from simultaneously lighting and improving reliability of the switching.

In the step D, the dimming channel of the constant current driving unit is connected with N LED light bars, when a total time of turning on each of the dimming channels is constant, the specific value of the time of turning on each of the LED light bars of the present disclosure and the time of turning on the typical LED light bar is 1/N, namely brightness of the LED light bar reduces. Thus, when the output voltage of the power supply or the duty cycle of the current of the LED light bar increases, the current flowing through the LED light bar correspondingly increases, which compensates brightness loss of the LED light bar.

The invention is described in detail in accordance with the above contents with the specific preferred examples. However, this invention is not limited to the specific examples. For the ordinary technical personnel of the technical field of the invention, on the premise of keeping the conception of the invention, the technical personnel can also make simple deductions or replacements, and all of which should be considered to belong to the protection scope of the invention.

We claim:

1. A light emitting diode (LED) backlight driving circuit, comprising:

a power supply;

a constant current driving unit that drives LED light bars;

a switching unit coupled to the power supply and comprising M change-over controllable switches that are connected with each other in parallel, and M light units that are connected with each other in parallel;

wherein each of the light units comprises at least two LED light bars that are connected with each other in parallel, and an input end of each of the LED light bars is coupled to the switching unit; the constant current driving unit comprises a plurality of dimming channels coupled to an output end of the LED light bars, each of the dimming channels is connected with M LED light bars, the M LED light bars connected with a same dimming channel are arranged in different light units, one LED light bar is coupled to one dimming channel;

the power supply is only coupled to one light unit through the switching unit when the LED backlight driving circuit is in operation; M is a positive integer; and wherein the switching unit comprises a delay switching unit coupled to the change-over controllable switch, the delay switching unit outputs a signal to turn off all change-over controllable switches in a preset delay time after a current light unit turns off, and the change-over controllable switch corresponding to a next light unit is driven to turn on.

2. The LED backlight driving circuit of claim 1, wherein an input end of each of the change-over controllable switches is coupled to the power supply, an output end of each of the change-over controllable switches is correspondingly connected with one light unit, only one change-over controllable switch turns on when the LED backlight driving circuit is in operation.

3. The LED backlight driving circuit of claim 2, wherein the dimming channel comprises a dimming controllable switch connected in series between an output end of the light unit and a ground terminal of the LED backlight driving circuit, the constant current driving unit comprises a control unit coupled to the dimming controllable switch.

4. The LED backlight driving circuit of claim 3, wherein the constant current driving unit further comprises a current compensator unit coupled to the control unit, and the current compensator unit is used to increase current flowing through the LED light bar.

5. The LED backlight driving circuit of claim 3, wherein the constant current driving unit further comprises a switching channel that controls the change-over controllable switch to turn on/off.

6. The LED backlight driving circuit of claim 5, wherein the constant current driving unit further comprises a current compensator unit coupled to the control unit, and the current compensator unit is used to increase current flowing through the LED light bar.

7. The LED backlight driving circuit of claim 5, further comprising a first resistor, a second resistor, a third resistor, and a fourth resistor; wherein the light unit comprises a first light unit and a second light unit, the change-over controllable switch comprises a first change-over controllable switch coupled to the first light unit, and a second change-over controllable switch coupled to the second light unit; the switching channel comprises a first control switch and a second control switch;

the first resistor is connected in series between a control end of the first change-over controllable switch and an output end of the power supply; a first end of the second resistor is coupled to the control end of the first change-over controllable switch, a second end of the second resistor is connected with a ground terminal through the first control switch; the third resistor is connected in series between a control end of the second change-over controllable switch and the output end of the power supply; a first end of the fourth resistor is coupled to the control end of the second change-over controllable switch, a second end of the fourth resistor is connected with the ground terminal through the second control switch.

8. The LED backlight driving circuit of claim 7, wherein the constant current driving unit further comprises a current compensator unit coupled to the control unit, and the current compensator unit is used to increase current flowing through the LED light bar.

9. The LED backlight driving circuit of claim 5, further comprising a first resistor, a second resistor, a third resistor, and a fourth resistor; wherein the light unit comprises a first light unit and a second light unit, the change-over controllable switch comprises a first change-over controllable switch coupled to the first light unit, and a second change-over controllable switch coupled to the second light unit; the first change-over controllable switch and the second change-over controllable switch are coupled to a same switching channel; the first change-over controllable switch turns on at a high level, the second change-over controllable switch turns on at a low level; the switching channel comprises a control switch;

the first resistor is connected in series between a control end of the first change-over controllable switch and an output end of the power supply; a first end of the second resistor is coupled to the control end of the first change-over controllable switch, and a second end of the second resistor is connected with a ground terminal through the control switch; the third resistor is connected in series between a control end of the second change-over controllable switch and the output end of the power supply; a first end of the fourth resistor is coupled to the control end of the second change-over controllable switch, a second end of the fourth resistor is connected with the ground terminal through the control switch.

10. The LED backlight driving circuit of claim 9, wherein the constant current driving unit further comprises a current compensator unit coupled to the control unit, and the current compensator unit is used to increase current flowing through the LED light bar.

11. A liquid crystal display (LCD) device, comprising:

a light emitting diode (LED) backlight driving circuit comprising a power supply, a constant current driving unit that drives LED light bars, a switching unit coupled to the power supply, wherein the switching unit comprises M change-over controllable switches that are connected with each other in parallel, an input end of each of the change-over controllable switches is coupled to the power supply, an output end of each of the change-over controllable switches is correspondingly connected with one light unit, one change-over controllable switch turns on when the LED backlight driving circuit is in operation; the constant current driving unit further comprises a current compensator unit coupled to the control unit, and the current compensator unit is used to increase current flowing through the LED light bar; and M light units that are connected with each other in parallel;

wherein each of the light units comprises at least two LED light bars that are connected with each other in parallel, an input end of each of the LED light bars is coupled to the switching unit;

the constant current driving unit comprises a plurality of dimming channels coupled to an output end of the LED light bars, each of the dimming channels is connected with M LED light bars, the M LED light bars connected with a same dimming channel are arranged in different light units, one LED light bar is coupled to one dimming channel;

the power supply is only coupled to one light unit through the switching unit when the LED backlight driving circuit is in operation; M is positive integer.

12. The LCD device of claim 11, wherein the dimming channel comprises a dimming controllable switch connected in series between an output end of the light unit and a ground terminal of the LED backlight driving circuit, the constant current driving unit comprises a control unit coupled to the dimming controllable switch.

13. The LCD device of claim 12, wherein the switching unit comprises a delay switching unit coupled to the change-over controllable switch, the delay switching unit outputs a signal to turn off all change-over controllable switches in a preset delay time after a current light unit turns off, and the change-over controllable switch corresponding to a next light unit is driven to turn on; the constant current driving unit further comprises a current compensator unit coupled to the control unit, and the current compensator unit is used to increase current flowing through the LED light bar.

14. The LCD device of claim 13, wherein the constant current driving unit further comprises a switching channel that controls the change-over controllable switch to turn on/off.

15. The LCD device of claim 14, wherein the light unit comprises a first light unit and a second light unit, the change-over controllable switch comprises a first change-over controllable switch coupled to the first light unit, and a second change-over controllable switch coupled to the second light unit; the switching channel comprises a first control switch and a second control switch;

the LED backlight driving circuit further comprises a first resistor, a second resistor, a third resistor, and a fourth resistor; the first resistor is connected in series between a control end of the first change-over controllable switch and an output end of the power supply; a first end of the second resistor is coupled to the control end of the first change-over controllable switch, a second end of the second resistor is connected with a ground terminal through the first control switch; the third resistor is connected in series between a control end of the second change-over controllable switch and the output end of the power supply; a first end of the fourth resistor is coupled to the control end of the second change-over controllable switch, a second end of the fourth resistor is connected with the ground terminal through the second control switch.

16. The LCD device of claim 14, wherein the light unit comprises a first light unit and a second light unit, the change-over controllable switch comprises a first change-over controllable switch coupled to the first light unit, and a second change-over controllable switch coupled to the second light unit; the first change-over controllable switch and the second change-over controllable switch are coupled to a same switching channel; the first change-over controllable switch turns on at a high level, the second change-over controllable switch tams on at a low level; the switching channel comprises a control switch;

the LED backlight driving circuit further comprises a first resistor, a second resistor, a third resistor, and a fourth resistor; the first resistor is connected in series between a control end of the first change-over controllable switch and an output end of the power supply; a first end of the second resistor is coupled to the control end of the first change-over controllable switch, and a second end of the second resistor is connected with a ground terminal through the control switch; the third resistor is connected in series between a control end of the second change-over controllable switch and the output end of the power supply; a first end of the fourth resistor is coupled to the control end of the second change-over controllable switch, a second end of the fourth resistor is connected with the ground terminal through the control switch.

17. A method for driving a light emitting diode (LED) backlight driving circuit, the LED backlight driving circuit comprising a power supply, a switching unit coupled to the power supply and comprising M change-over controllable switches that are connected with each other in parallel, wherein the switching unit comprises a delay switching unit coupled to the change-over controllable switch, the delay switching unit outputs a signal to turn off all change-over controllable switches in a preset delay time after a current light unit turns off, and the change-over controllable switch corresponding to a next light unit is driven to turn on LED light bars, and a constant current driving unit that drives the LED light bar to light; the method comprising:

A: connecting M light units with each other in parallel, wherein N light bars are one light units, and the N LED light bars are connected with each other in parallel; wherein M and N are positive integers;

B: connecting M LED light bars with a same dimming channel of the constant current driving unit, wherein the M LED light bars are arranged in different light units;

C: controlling one light unit to couple to the power supply when the LED backlight driving circuit is in operation; and D: controlling the dimming channel of the constant current driving unit to turn on when one light unit turns on.

* * * * *